United States Patent [19]

Ackerman et al.

[11] 4,351,082

[45] Sep. 28, 1982

[54] OSCILLATING SOOT BLOWER MECHANISM

[75] Inventors: Dean C. Ackerman; Don W. Smith, both of Lancaster, Ohio

[73] Assignee: The Babcock & Wilcox Company, New Orleans, La.

[21] Appl. No.: 255,371

[22] Filed: Apr. 20, 1981

[51] Int. Cl.[3] ..... F23J 3/02

[52] U.S. Cl. ..... 15/316 R

[58] Field of Search ..... 15/316 R, 316 A, 317, 15/318

[56] References Cited

U.S. PATENT DOCUMENTS

| | | | |
|---|---|---|---|
| 3,230,568 | 1/1966 | Saltz | 15/317 |
| 3,439,376 | 4/1969 | Nelson et al. | 15/317 |
| 4,177,539 | 12/1979 | Elting | 15/316 |

*Primary Examiner*—Chris K. Moore

*Attorney, Agent, or Firm*—Harness, Dickey & Pierce

[57] ABSTRACT

An accessory transmission conversion mechanism of the type disclosed in the U.S. Pat. No. 4,177,539, to Elting, for causing the lance tube of a long retracting soot blower to oscillate about its longitudinal axis, is provided with a lost motion driving connection between the yoke driving gear and the crank of the Scotch yoke which generates the oscillating motion. A holding portion on the gear permits locking out such lost motion when desired. When lost motion is present, the blowing path is automatically changed when the blower reverses. When locked out, the blowing pattern is changed so that the jet traces the same path in each direction of movement.

5 Claims, 8 Drawing Figures

FIG. 1.
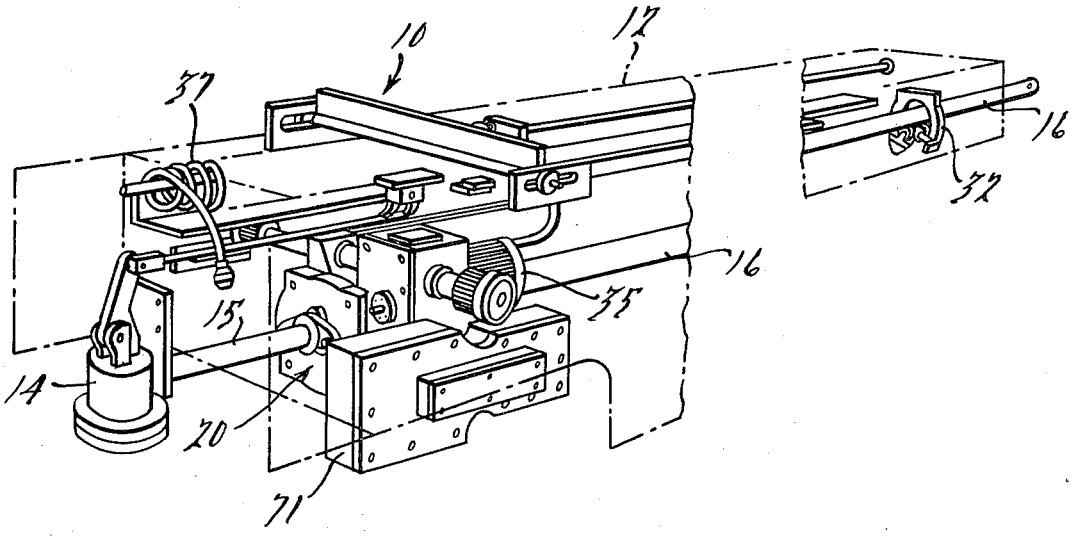
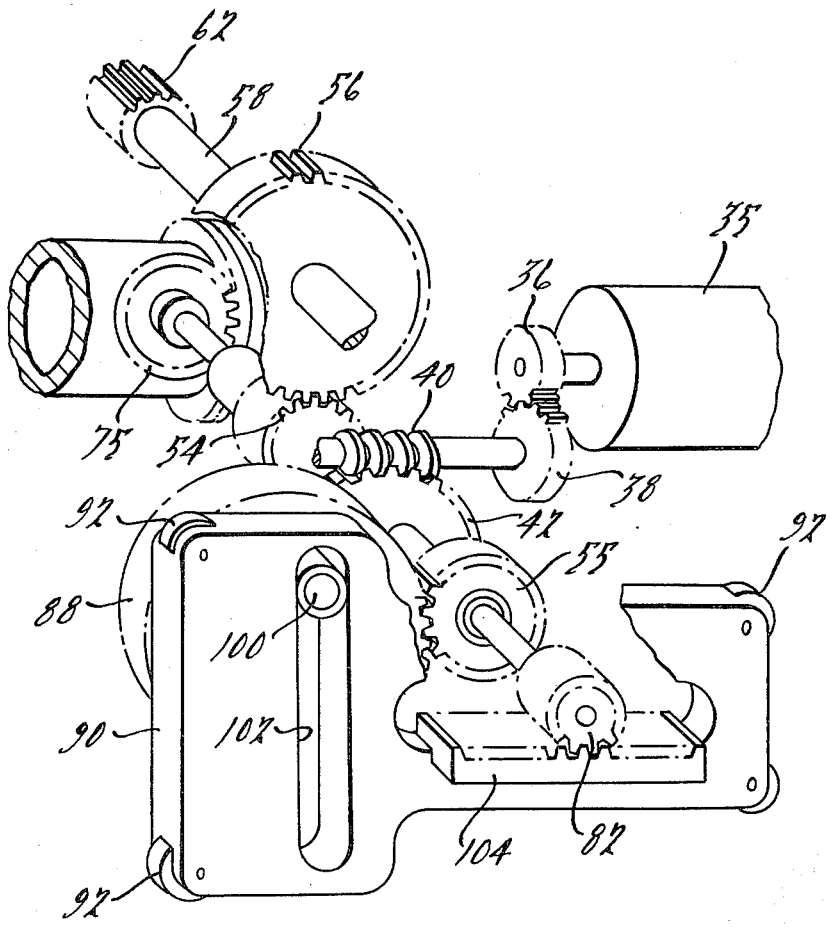
FIG. 2.

FIG. 3.
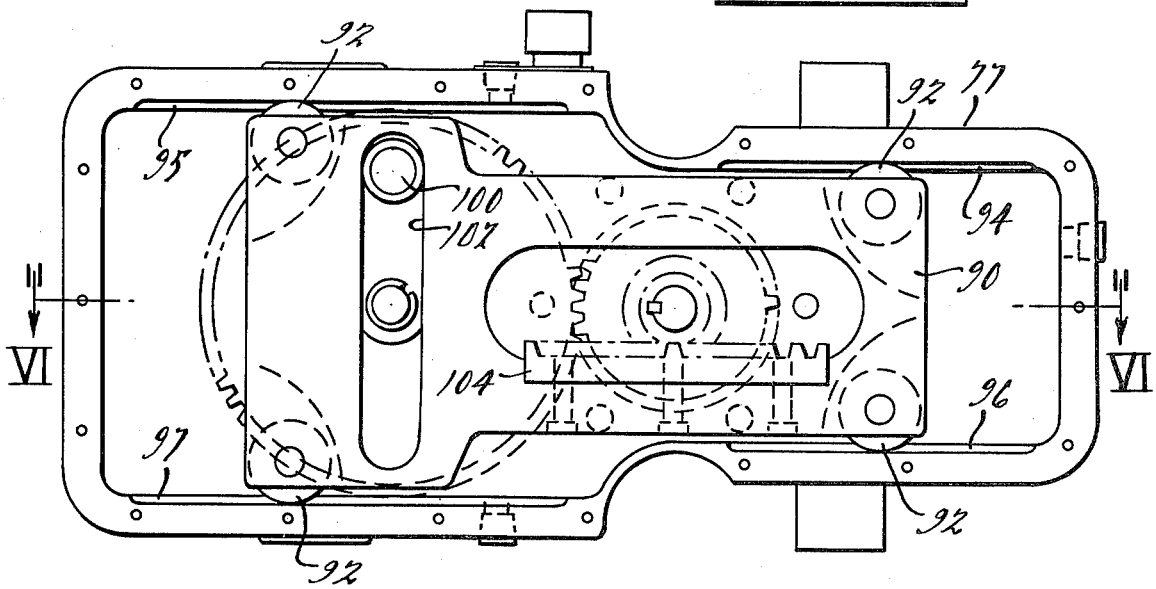
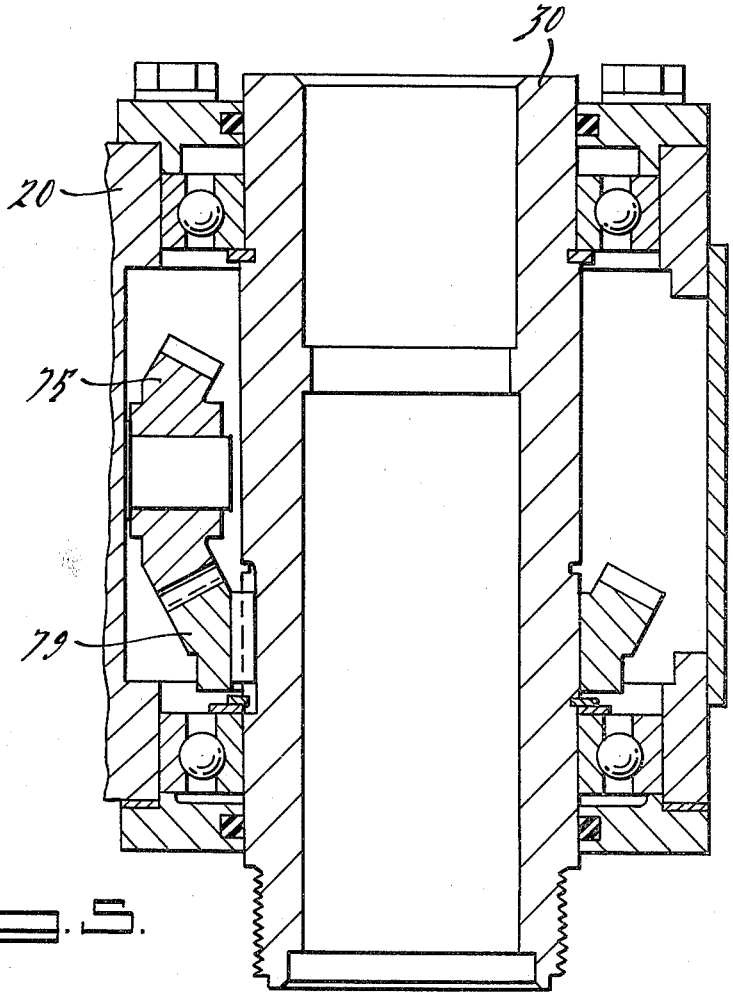
FIG. 5.

OSCILLATING SOOT BLOWER MECHANISM

BACKGROUND OF THE INVENTION

Retracting-type soot blowers for cleaning the heat exchanging surfaces of large public utility boilers and the like by discharging steam and/or air and/or water against such surfaces in the form of one or more powerful jets are commonly designed to discharge the cleaning jets in a helical or spiral pattern, or, in the case of an oscillating blower, in the form of an alternately reversed incomplete helical or spiral cleaning pattern. In order to index or stagger the jet paths which define the patterns of non-oscillating blowers, it has been known to provide a lost motion connection between the lance tube and its driving hub. Such a lost motion connection, while effective to properly stagger the cleaning path of the jets of continuously rotating, non-oscillatory blowers, is not effective to properly stagger the jet paths of an oscillating blower. If used in an oscillating blower, the known staggering or "indexing" means would introduce an undesirable dwell interval at each reversal of the direction of angular movement during longitudinal travel of the lance. An important object of the present invention is to provide improved means for indexing or staggering the jet paths of oscillatory retracting soot blowers. Another object is to provide such means which is incorporated in a very compact but rugged and reliable mechanism, by means of a simple gear and crank modification adapted to be substituted in place of one of the gears of an accessory transmission conversion unit corresponding to the unit disclosed in said U.S. Pat. No. 4,177,539. Such patented conversion units are designed for selective installation on standard non-oscillating soot blowers, to convert them to oscillating action when desired. The present invention permits such conversion units to selectively function to provide either staggered or non-staggered (indexed or non-indexed) patterns, as operating conditions may require. A related advantage of the invention is that it incorporates readily accessible, conveniently operable means for changing the blowing pattern from staggered to non-staggered form, and vice-versa.

Other objects and advantages will become apparent to persons skilled in the art upon consideration of the present disclosure in its entirety.

BRIEF DESCRIPTION OF THE FIGURES OF DRAWING

FIG. 1 is a perspective view, partly broken away, of a long travel soot blower incorporating oscillating transmission mechanism embodying the present invention;

FIG. 2 is a diagrammatic perspective view of the principal components of the gearing and yoke system;

FIG. 3 is a side elevational view of the accessory housing with the cover removed;

FIG. 5 is a fragmentary sectional plan view taken substantially on the line V—V of FIG. 4 and looking in the direction of the arrows;

DETAILED DESCRIPTION OF PREFERRED FORM OF THE INVENTION

Figure 4:
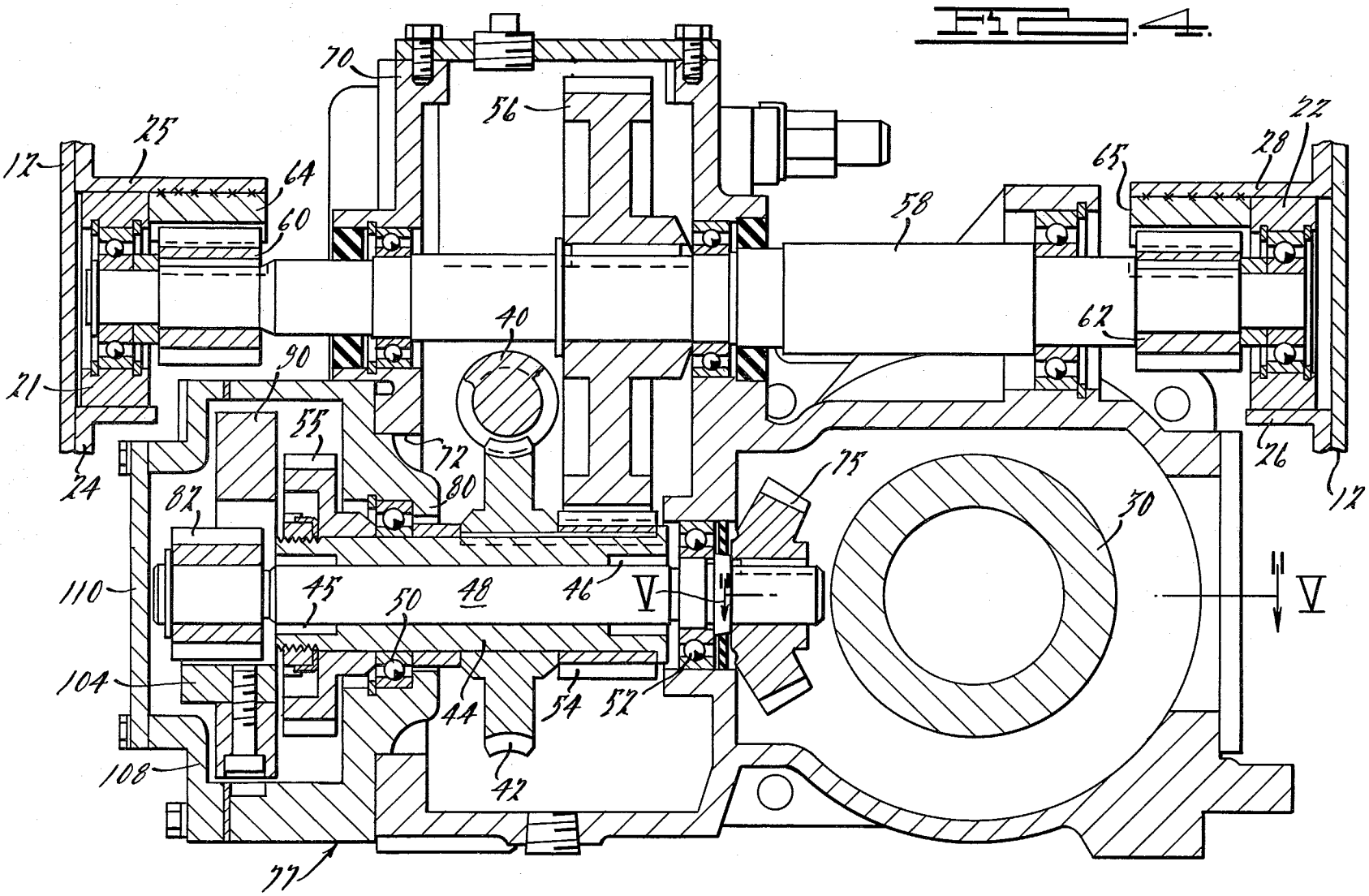
FIG. 4 is a cross-sectional view of the transmission mechanism taken on a vertical plane through the walking pinions and looking toward the rear.
Figure 6:
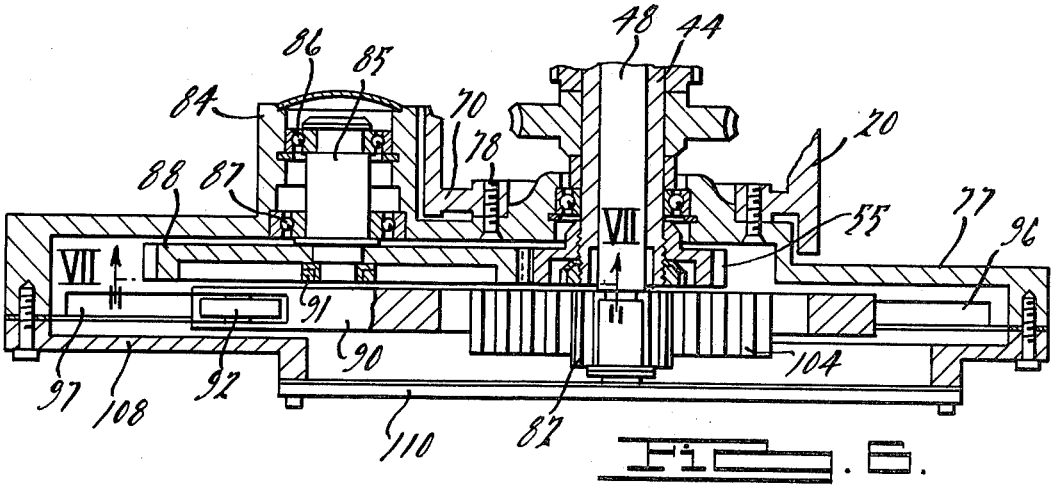
FIG. 6 is a sectional plan view corresponding to a cross section taken substantially on the line VI—VI of FIG. 3 and looking in the direction of the arrows.

Reference character 10 designates generally a soot blower of the so-called "IK" long travel type. The general construction of the soot blower corresponds to the disclosure of Nelson et al U.S. Pat. No. 3,439,376, granted Apr. 22, 1969, although the disclosure of said patent includes a showing of a contoured rail structure and supplemental suuporting means for preventing undue sagging of the lance tube and of the feed tube, which features are only required where the blower is of great length, so that sagging of these components becomes a problem. In blowers which are not designed for such extreme extension, the beam and tracks are typically made straight, as shown in FIG. 1 hereof. In FIG. 1 the beam structure, which is basically in the form of an inverted U channel, is not illustrated, but its position is indicated at 12 in broken lines. The blower, as is conventional, includes a blow valve 14 supported at the rear end of the beam and to which is attached a fixed feed tube 15. The lance tube 16, which is slidably overfitted on the feed tube 15 is secured at its rear end to a hub 30 rotatable in the carriage 20. The carriage is supported in the beam to travel therealong on rollers 21, 22. The rollers are confined between lower and upper track elements 24, 25, 26, 28 secured to the inner sidewalls of the beam. The lance tube, which is thus rotatable about its longitudinal axis as well as actuatable longitudinally by the carriage, is supported at its forward end adjacent the wall box (not shown) at the boiler wall, by means of a pair of rollers mounted in a roller bracket assembly 32 attached to the forward end of the beam 12, to control the path of the lance into and out of the boiler setting (not shown).

A motor 35 is secured to the foward wall of the carriage housing 20 and receives power through a flexible conductor assembly 37. The flexible conductor assembly does not comprise a part of the present invention, but may correspond to one of the known commercial types disclosed in the U.S. Pat. No. 3,823,279 to Rausch, et al, granted July 9, 1974, or in the U.S. Pat. No. 3,819,880, to Johnston, granted June 25, 1974. The motor, through a pair of spur gears 36, 38 drives a worm 40, which drives a worm wheel 42 fast on a tubular idler shaft 44 journaled by means of bearings 45, 46 on an internal shaft 48. Interfitted shafts 44, 48 are rotatably supported transversely of the carriage in antifriction bearing assemblies 50, 52. The concentric interfitted shafts 44, 48, the gears, bearings, etc. carried thereby, and parts to be described contained in an accessory housing assembly 77, 108, 110 comprise a unitized conversion or accessory transmission assembly.

The radially outer tubular idler shaft 44 carries fast thereon, in addition to worm wheel 42, a pinion 54 and a spur gear 55. Pinion 54 meshes with a gear 56 fast on a cross shaft 58 rotatably supported in and near the top of the carriage and extending transversely thereof and outwardly therefrom to carry at its outer extremities the rollers 21, 22. Adjacent each roller is a pinion 60, 62 fast on the shaft 58. The pinions 60, 62 mesh with racks 64, 65 secured to the undersides of the upper track portions 25, 28 and act as walking pinions to drive the carriage along the beam, in the known manner.

In a non-oscillating soot blower of the indicated "IK" type, a single solid shaft positioned correspondingly to but shorter than the shaft 48 carries fast thereon gears corresponding to the gears 42 and 54, and also carries at its inner end a bevel gear corresponding to the gear 75 which imparts rotary drive to the hub 30 and thereby to the lance. Thus in the conventional or unmodified blower the rotation of such solid shaft corresponding to the shaft 48 imparts continuous longitudinal motion to the carriage and lance via the gear 56, and also continuous rotary motion to the lance via the bevel gears 75, 79.

In oscillating modified soot blowers equipped with oscillating mechanism constructed in accordance with the aforementioned Elting U.S. Pat. No. 4,177,539, however, the concentric shafts 44, 48 project outside the carriage housing, through the concentric opening 72 in the side wall 70 of the carriage, and into the accessory housing portion 77 secured to the wall 70. A boss 80 integral with housing portion 77 is accurately piloted in the opening 72, and housing portion 77 is secured to the wall 70 by machine screws 78 engaged in tapped holes (undesignated) in the wall 70 which normally receives the screws for securance of the combined closure and bearing support employed in the unmodified blower construction to carry the aforementioned single solid shaft. (In this connection reference may be made to FIGS. 4 and 5 of the drawings of U.S. Pat. No. 3,439,376).

Directly behind and close to the rear wall of the carriage housing 20 and in alignment with the interfitted shafts 44, 48 the housing portion 77 is provided with an integral bearing boss 84 within which a stub shaft 85 is journaled in suitable antifriction bearings 86, 87. Stub shaft 85 carries within the housing portion 77 a crank driving gear 88 meshing with and drivable by the gear 55, which is fast on the outer end of shaft 44 within housing portion 77. Shaft 48 projects beyond tubular shaft 44 and at its outer end carries fast thereon the yoke driven gear 82. Yoke member 90 is reciprocably mounted in housing portion 77 by means of suitable rollers as 92 engaging track portions 94, 95, 96, 97 carried by the inner surfaces of the upper and lower walls of housing portion 77. Rack portion 104 meshes with pinion 82 to oscillate shaft 48, pinion 75 and gear 79 which is fast on hub 30, thereby oscillating the lance tube 16 which is attached to the hub.

In accordance with the present invention a crank 91 journaled loosely on shaft 85 is fitted in a recess generally designated 120 in the front face of the gear 88 and carries a crank pin 100 which engages in the yoke slot 102 to actuate the yoke. The recess 120 includes a sector-shaped portion 121 terminating at its ends in abutment walls 122, 123 which limit relative angular movement between the gear 88 and crank 91. A straight narrow radial slot-like portion 125 of recess 120 is provided to form a lockup keying means adapted to prevent independent angular movement of the gear and crank 88, 91. Recess portion 125 is of a width to receive and closely engage the sides of the crank, which is removably retained on shaft 85 by a snap ring 126.

Figure 7:
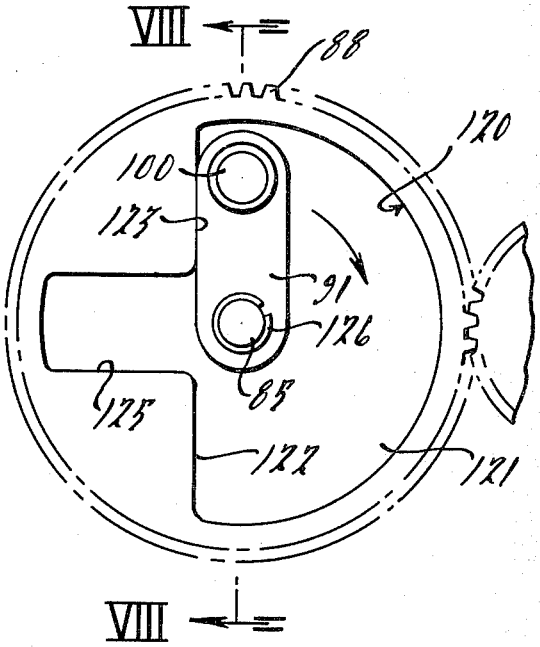
FIG. 7 is a sectional elevational view taken as indicated by the line and arrows VII—VII of FIG. 6 and looking in the direction of the arrows.
Figure 8:
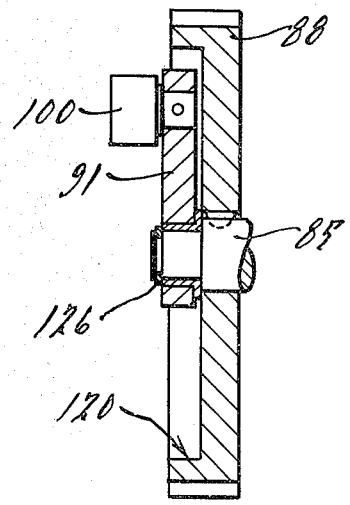
FIG. 8 is a cross-section taken substantially on the line VIII—VIII of FIG. 7 and looking in the direction of the arrows.

In FIGS. 7 and 8 the crank is shown in the sector-shaped portion 121 of recess 120. Under such conditions, when gear 88 is rotated in one direction during operation of the blower, e.g. the direction required to project the lance 16, one of the abutment walls as 122 will engage and remain in engagement with the crank throughout the projection of the lance, thereby reciprocating the rack portion 104 carried by the yoke to continuously oscillate the lance throughout such projection.

When the motor is reversed, e.g.: to retract the lance, the angular direction of rotation of gear 88 is reversed, and accordingly, although a reverse longitudinal movement of the lance commences immediately, oscillatory actuation of the lance about its axis is delayed until the opposite abutment wall, i.e. wall 123, engages the crank, whereafter continuing rotation in the same direction again oscillates the lance about its axis. The angular length of sector portion 121 and resultant dwell are preferably selected so that the helical jet paths during projection and retraction are equally longitudinally spaced from each other.

The angular motion imparted to the lance is variable by changing the position of installation of the crank pin 100.

If cleaning requirements make it desirable to employ the same blowing path during both projection and retraction, the crank is placed in the narrow slot-like portion 125 of recess 120. The staggered blowing patterns which occur when the crank is in sector area 121 are thereby eliminated, and the oscillatory movement reverses immediately when the motor is reversed, so that the blowing pattern is the same in both directions.

If a change in fouling conditions, due to a change of fuel or other reasons, makes it desirable to change the blowing pattern, this is easily accomplished by removing cover 108, sliding out the yoke-rack assembly 90/104, removing the snap ring 126 and the crank 91, and reinstalling the crank in the other portion (121 or 125) of the recess. An access plate 110 on cover 108 is separately removable to permit inspection and lubrication.

The compact assembly of the crank in the recess in gear 88 preserves the advantages of the design of U.S. Pat. No. 4,177,539, permitting conventional blowers which lack any oscillating mechanism to be modified in a simple manner despite the limited space available in the channel-type beam 12, to provide for oscillation of the lance either with or without indexed blowing patterns. Such work can be performed in the field if necessary, simply by removing the conventional shaft and gear assembly from the position corresponding to that in which the interfitted shafts 44, 48 are shown in the present disclosure, and substituting the telescoped shafts, conversion transmission assembly, etc. Of course any lost motion indexing feature at the hub 30 will also be locked up in making such conversions.

This Detailed Description of the preferred form of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

While a preferred embodiment of the invention has been described herein, it will be appreciated that various modifications and changes may be made without departing from the spirit and scope of the appended claims.

We claim:

1. In a long travel soot blower or the like having a supporting beam, a carriage adapted to travel along the beam and including a housing forming an enclosure for the carriage, a lance secured to the carriage to travel therewith but rotatable about its longitudinal axis, longitudinal rack means carried by the beam, a motor operatively interconnected with the carriage, walking pinion means carried by the carriage and rotatable to drive the carriage and lance along the beam, transmission means for rotating the walking pinion means and for oscillating the lance about its longitudinal axis including a pair of interfitted independently rotatable shafts journaled in but projecting at their outer ends outside said housing of the carriage, the radially outer of said shafts being drivable by the motor and having gear means thereon within the carriage housing for driving said walking pinion means to actuate the carriage along the beam, a yoke driving gear on the projecting outer end of said radially outer shaft, the outer end of the radially inner shaft extending beyond the outer end of the radially outer shaft, an inner end of said radially inner shaft having a rotary driving connection to the lance within the carriage housing, a yoke driven gear on the outer end of the radially inner shaft, an accessory housing secured to the outside of the carriage housing and enclosing said two last-mentioned gears, a Scotch yoke in said accessory housing for oscillating the yoke driven gear and the radially inner shaft to oscillate the lance about its longitudinal axis during longitudinal travel thereof, and means for actuating the yoke comprising a crank, characterized by a lost motion driving connection between the yoke driving gear and the crank, whereby the yoke driven gear is continuously oscillated while the yoke driving gear is rotating in one direction, but oscillation of the driven gear is interrupted when the direction of rotation of the yoke driving gear is reversed, and recommences at a different longitudinal position of the lance after the lost motion is taken up during reversed rotation of the yoke driving gear.

2. Transmission means as defined in claim 1 including a crank driving gear drivable by said yoke driving gear, the crank and yoke driving gear being independently journaled in coaxial relation, said lost motion connection being defined by angularly spaced abutment portions on said crank and yoke driving gear.

3. Means as defined in claim 2 including releasable lockup means for selectively securing the crank and crank driving gear against lost motion relative to each other.

4. Means as defined in claim 3 wherein driving gear has an additional narrower radial recess defining said lockup means into which the crank can be fitted to secure the crank and crank driving gear against lost motion.

5. Means as defined in claim 2 wherein the crank driving gear is provided with a sector-shaped recess with which the crank is interfitted, the peripheral ends of said recess defining abutments limiting the lost motion travel.

* * * * *

UNITED STATES PATENT AND TRADEMARK OFFICE

CERTIFICATE OF CORRECTION

PATENT NO. : 4,351,082

DATED : September 28, 1982

INVENTOR(S) : Dean C. Ackerman and Don W. Smith

It is certified that error appears in the above-identified patent and that said Letters Patent are hereby corrected as shown below:

Column 2, line 16, "suuporting" should be --supporting--.

Column 6, line 19, renumber Claim 4 as Claim 5. Same line, change "3" to --4--. Same line, after "wherein" insert --the crank--.

Column 6, line 24, renumber Claim 5 as Claim 4.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*